United States Patent [19]

Klinge

[11] Patent Number: 4,888,964

[45] Date of Patent: Dec. 26, 1989

[54] PLEATED KNIT FABRIC

[76] Inventor: Svein Klinge, 34 Whaleback Terrace, Ringwood, N.J. 07456

[21] Appl. No.: 158,611

[22] Filed: Feb. 22, 1988

[51] Int. Cl.[4] ..... D04B 23/08

[52] U.S. Cl. ..... 66/193; 66/145

[58] Field of Search ..... 66/190, 192, 193, 195, 66/169, 170, 171

[56] References Cited

U.S. PATENT DOCUMENTS 3,859,825 1/1975 Foulquies et al. ..... 66/192

4,048,819 9/1977 Johnson ..... 66/177

*Primary Examiner*—Ronald Feldbaum

*Attorney, Agent, or Firm*—Robert W. Fiddler

[57] ABSTRACT

A pleated knit fabric and method for forming same on a single needle bar knitting machine. The fabric is knit on a single needle bar knitting machine having at least three guide bars. A first group of yarns is formed on two of the guide bars to form a stitch group A having spaced wales with vacant needles therebetween joined by laid-in stitches extending between the spaced wales to form a base fabric. A second group of stitches forming a stitch group B is formed on the third guide bar, utilizing at least some of the vacant needles between the wales of the stitch group, said second group of stitches, group B, is joined to one of the wales of the first group of stitches, with the second group of stitches having a free portion, loose with respect to the first group of stitches so as to form a pleat-like flap.

12 Claims, 1 Drawing Sheet

PLEATED KNIT FABRIC

This invention relates to a pleated knit fabric, and more particularly to a knit fabric and method of forming same on a single needle bar Raschel machine to provide desired rapidity of production.

BACKGROUND OF THE INVENTION

With the development of warp knitting technology, a variety of desirable patterns have been evolved. Satisfactory production of a pleated knit fabric has heretofore not been available.

BRIEF DESCRIPTION OF THE INVENTION

It is with the above considerations in mind that the present improved knit fabric construction has been evolved permitting the use of single needle bar machines for the rapid and effective formation of a variety of pleat-like knit fabrics.

It is among the primary objectives of the invention to provide a pleat-like knit fabric construction.

Another object of the invention is to provide a method of forming a pleat-like knit fabric on a single needle bar machine of the Raschel type.

These and other objects of the invention which will become hereafter apparent are achieved by setting up a single needle bar warp knitting machine having at least two guide bars to form a first group of stitches, here referred to as stitch group A, with at least two spaced wales of stitches with vacant needles therebetween with said spaced wales joined by a laid-in thread extending between said wales to form a base fabric. A second group of stitches, here referred to as stitch group B, is formed on the third bar utilizing at least some of the vacant needles between the wales of the first stitch group A. One end of the stitch group B stitches is secured to the group A stitches, so that the unsecured portion of the group B stitches forms a pleat-like flap with respect to the base fabric formed by the group A stitches.

A feature of the invention resides in the development of a method for forming a pleat-like knit fabric on a single needle bar knitting machine of the Raschel type with pleat-like subject to selective formation of desired length and contour with respect to the base fabric.

DRAWING DESCRIPTION

The specific details of the best mode contemplated for practicing the invention and of the manner and process for making and using it will be described in full, clear, concise and exact terms so as to enable those skilled in the art to practice same in conjunction with the accompanying drawings wherein.

DESCRIPTION OF PREFERRED EMBODIMENT

Figure 1:
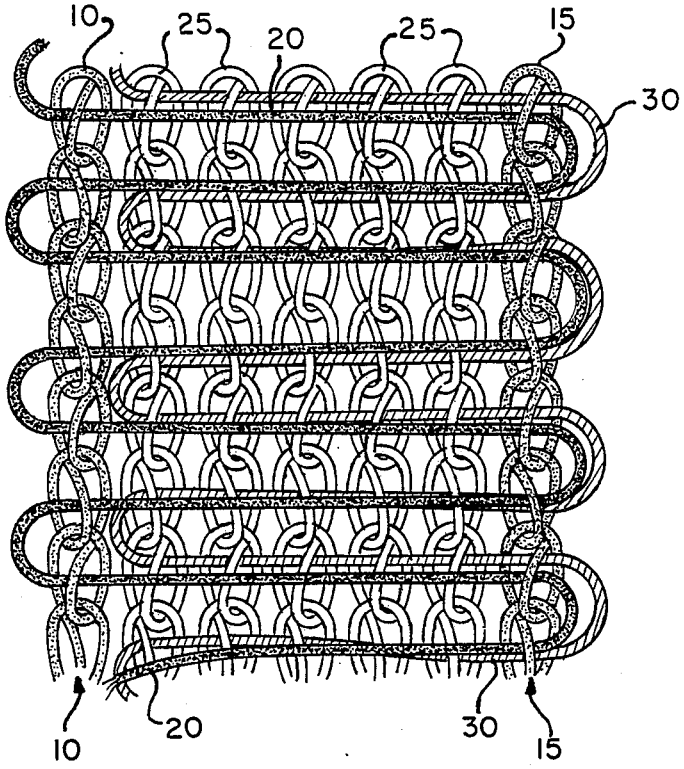
FIG. 1 is a view of a knitted fabric made in according with the method of the invention, showing the base fabric in darkened threads, and the pleat-like flap forming stitches in undarkened threads.

As illustratively shown, the fabric shown in FIG. 1 is formed with a group of stitches A, identified by the dark threads, with stitch group A having wale 10 separated from wale 15, with the wales 10 and 15 of group A joined by laid-in yarns 20 to form a base layer.

The desired pleat-like flap is formed by a group of stitches B knit on at least one bar behind or under the two front bars employed for forming the stitches of group A. These group B stitches shown light on FIG. 1 are as illustratively shown formed as of a plurality of wales 25 of chain stitches joined together by a laid-in yarn 30 shown in cross-hatch line in FIG. 1. This laid-in yarn not only joins the wales 25 of chain stitches forming stitch group B to each other, but also join one edge (the right hand as viewed in FIG. 1) of this stitch group B to one of the wales, (wale 15) of the group A stitches, at the right as illustratively shown in FIG. 1.

In forming this pleated knit fabric construction on a single needle bar machine, it is necessary that the group B stitches lie between the wales of the group A stitches.

Figure 2:
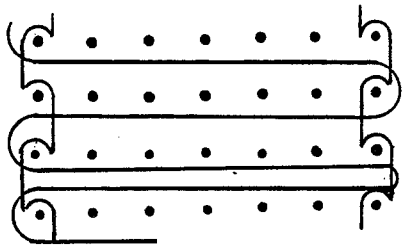
FIG. 2 shows some illustrative needle threading patterns for forming the base fabric group A stitches.
Figure 3:
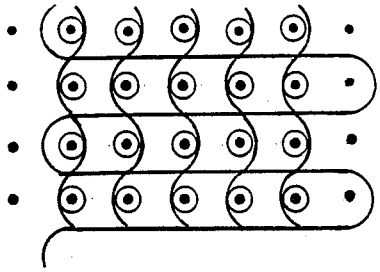
FIG. 3 shows some illustrative needle threading patterns for forming the pleat group B stitches.

As shown by the stitch pattern in FIGS. 2 and 3 (employed in forming the stitches of a fabric in accordance with the invention), the stitches may be either open or closed.

Thus, the stitches forming the wales of group A as shown in FIG. 2 are illustratively shown as open, with the laid-in yarn extending between the two separated wales. As will be understood by those skilled in the art, the stitches may be looped as illustratively shown in FIG. 3.

The group B lapping movement pattern illustratively shown in FIG. 3 may similarly employ either an open or closed stitch pattern for the group B stitches, which are formed on the third guide bar in back or under the guide bars employed in forming group A.

Thus, according to the method, the thread is knit in two groups, a stitch group A on two front guide bars which serve to form the base fabric, and a stitch group B forming the pleat. The two front guide bars are threaded to provide at least two spaced wales 10 and 15, as seen in FIG. 1, with unthreaded needles therebetween, and the wales 10 and 15 are joined by a laid-in thread 20 extending between the wales.

The stitches of group B are formed on a third guide bar, and a connection is formed between the group B stitches at least one of the wales of the base fabric formed by the group A stitches on guide bars 1 and 2.

In order to knit the fabric on a single needle bar machine, as will be apparent to those skilled in the art, it is essential that the width of the group B stitches is less than that of the group A stitches, thus permitting the formation of the group B stitches on the unused needles between the wales of the group A stitches. The float of A must be greater than that of B. The chain stitch employed for forming the wales of group A may be formed on front guide bar 1 or 2, with the laid-in stitch of group A formed on the other bar of the one selected for forming the wales.

The group B stitches forming the pleat are attached to the base fabric stitches of group A along only one wale and must have at least one knitted bar. However, many bars may be employed to form the pleat depending on the pattern desired. The important thing is that group B is smaller than group A.

A typical three bar stitch pattern will be as follows:

Front bar 1: 2/0, 0/2

Middle Bar 2: 0/0, 12/12

Back bar 3: 2/0, 2/4

As will be understood by those skilled in the art, the single needle bar knitting machine may be set up to provide desired patterns for either the base fabric and- /or the pleating. However, in practicing the invention, it is essential that at least three bars be available, two front bars for knitting the base fabric, and at least one rear guide bar for forming the pleat.

The above disclosure has been given by way of illustration, and not by way of limitation, and it is desired to protect all embodiments of the here and disclosed inventive concept within the scope of appended claims.

What is claimed is:

1. A method for knitting a pleated fabric on a knitting machine having at least three guide bars, said method comprising the steps of: knitting two groups of stitches, group A and group B; forming stitch group A as two wales of spaced chain stitches; laying in a yarn joining said spaced wales; forming stitch group B as a series of adjacent wales of chain stitches from thread coming from a guide bar different from those employed in forming the group A stitches, one of said wales of group B joined to a wale of group A.

2. A method as in claim 1 in which a single needle bar machine is employed.

3. A method as in claim 1 in which the stitches of group B are formed behind the stitches of group A.

4. A method as in claim 1 in which a yarn is laid-in between the spaced wales of group A.

5. A method as in claim 1 in which the group A stitches are knitted from thread coming from two front guide bars.

6. A method as in claim 5 in which the group B stitches are knitted from thread fed from a rear guide bar.

7. A method as in claim 6 in which the group B stitches are closed.

8. A method as in claim 1 in which the spacing between the wales of group A is greater than the width of the group B stitches.

9. A warp knit fabric comprising: a first group of chain stitches forming a first wale, and a second group of spaced chain stitches forming a second wale, spaced from said first wale a distance of at least five wales of chain stiches; a series of laid-in yarns between siad first and second wales joining same into a base fabric; and a flap forming group of chain knit stitches formed by a plurality of adjacent wales with a yarn laid between the said adjacent wales to join same, said laid-in yarn anchored at one end to said second wale to form a flap.

10. A knitted pleated fabric as in claim 1 in which said second group of stitches are anchored to said first group of stitches by a laid-in thread.

11. A knitted pleated fabric as in claim 9 in which said laid-in thread joins the stitches of said second group to each other.

12. A knitted pleated fabric as in claim 9 in which only one edge of said second group of stitches is joined to a wale of said first group of stitches.

* * * * *